US010104737B2

(12) United States Patent
Lou et al.

(10) Patent No.: US 10,104,737 B2
(45) Date of Patent: Oct. 16, 2018

(54) DIMMER CONTROL CIRCUIT, DIMMER CONTROL METHOD AND LIGHTING DEVICE CONTAINING THE SAME

(71) Applicant: SENGLED CO., LTD., Shanghai (CN)

(72) Inventors: Junshan Lou, Shanghai (CN); Zhenfeng Ding, Shanghai (CN); Jinxiang Shen, Shanghai (CN)

(73) Assignee: SENGLED CO., LTD., Shanghai (CN)

( * ) Notice: Subject to any disclaimer, the term of this patent is extended or adjusted under 35 U.S.C. 154(b) by 0 days.

(21) Appl. No.: 15/545,627

(22) PCT Filed: Nov. 2, 2016

(86) PCT No.: PCT/CN2016/104310
§ 371 (c)(1),
(2) Date: Jul. 21, 2017

(87) PCT Pub. No.: WO2017/080394
PCT Pub. Date: May 18, 2017

(65) Prior Publication Data

US 2018/0020517 A1 Jan. 18, 2018

(30) Foreign Application Priority Data

Nov. 9, 2015 (CN) ..... 2015 1 0756310

(51) Int. Cl.
*H05B 37/02* (2006.01)
*H05B 33/08* (2006.01)

(52) U.S. Cl.
CPC ..... *H05B 33/0851* (2013.01); *H05B 33/0809* (2013.01); *H05B 33/0815* (2013.01); *H05B 33/0845* (2013.01)

(58) Field of Classification Search
CPC ..... H05B 33/0809; H05B 33/0815; H05B 33/0845
(Continued)

(56) References Cited

U.S. PATENT DOCUMENTS

2012/0256553 A1* 10/2012 Chen ..... H05B 33/0845 315/205
2013/0342129 A1* 12/2013 Vaughan ..... H02M 1/14 315/240

(Continued)

FOREIGN PATENT DOCUMENTS

CN 203872419 U 10/2014
CN 105246218 A 1/2016
CN 205213101 U 5/2016

*Primary Examiner* — Tung X Le
(74) *Attorney, Agent, or Firm* — Anova Law Group, PLLC

(57) ABSTRACT

The present disclosure provides a dimmer control circuit, a dimmer control method and a lighting device. The dimmer control circuit includes: a dimming output end configured to connect to a dimmer, a load terminal configured to connect to a load, a detection-control module, and a current holding module. An input end of the detection-control module is connected to an output end of the dimmer. An output end of the detection-control module is configured to: control the current holding module to connect to the load terminal when the dimming output end is connected to a SCR-based leading-edge phase cut dimmer, and control the current holding module to disconnect from the load terminal when the dimming output end is not connected to the SCR-based leading-edge phase cut dimmer. The current holding module is configured to supply a holding current to the SCR-based leading-edge phase cut dimmer connected to the dimming output end.

15 Claims, 6 Drawing Sheets

(58) Field of Classification Search
USPC ..... 315/219, 224, 291, 307
See application file for complete search history.

(56) References Cited

U.S. PATENT DOCUMENTS

2014/0265888 A1 9/2014 Ekbote
2014/0333228 A1* 11/2014 Angeles ..... H05B 33/0815
315/291

* cited by examiner

DIMMER CONTROL CIRCUIT, DIMMER CONTROL METHOD AND LIGHTING DEVICE CONTAINING THE SAME

CROSS-REFERENCES TO RELATED APPLICATIONS

This application is a national phase entry under 35 U.S.C. § 371 of International Application No. PCT/CN2016/104310, filed on Nov. 2, 2016, which claims priority of Chinese Patent Application No. 201510756310.0 filed on Nov. 9, 2015, The above enumerated patent applications are incorporated by reference herein in their entirety.

FIELD OF THE DISCLOSURE

The present disclosure relates to the field of electronic circuit and, more particularly, relates to a dimmer control circuit, a dimmer control method, and a lighting device.

BACKGROUND

With the development of technologies, electronic lighting devices (e.g., LED lamps) that utilize equivalent electric load have gradually replaced traditional incandescent lamps, and thus becoming illumination sources in people's daily life.

Currently, LED dimmers are utilized to adjust the current or voltage of the power supply, so that as the load, a LED lamp can output lights with different brightness. Specifically, there are two main types of LED dimmers: silicon controlled rectifier based leading-edge phase cut dimmer (also called forward-phase control dimmer, or FPC dimmer) and transistor-based trailing-edge phase cut dimmer (also called reverse-phase control dimmer, or RPC dimmer).

FIG. 1 illustrates a wave-function diagram of a leading-edge phase cut AC sinusoidal voltage. As shown in FIG. 1, the leading-edge phase cut dimmer (SCR-based) utilizes the properties of a silicon controlled rectifier (SCR) to perform phase cutting from the start of each AC power source half-cycle, and after a certain period of time corresponding to the dimming positions, the circuit starts conducting to supply power to the load till the end of the half cycle. After passing the zero-crossing point, the same operation is repeated, thus changing the effective value of the AC current. That is, when the leading-edge phase cut dimmer (SCR-based) performs phase cutting, namely, starting from the zero-crossing point in the AC phase, the input voltage is chopped, and until when the SCR device is conducting, the voltage input recovers. Specifically, when the leading-edge phase cut dimmer (SCR-based) is triggered, a certain period of time is required to load the current to keep the dimmer conducting. This current is called a holding current, and if the holding current is removed or weakened, the leading-edge phase cut dimmer (SCR-based) is then turned off.

FIG. 2 illustrates a wave-function diagram of a trailing-edge phase cut AC sinusoidal voltage. As shown in FIG. 2, when the AC phase is zero, the trailing-edge phase cut dimmer (transistor-based) is triggered and starts conducting, and after a period of time corresponding to the dimming positions, the dimmer is turned off to realize phase cutting. The trailing-edge phase cut dimmer (transistor-based) controls the switch-on and switch-off of the field effect transistor via a timing circuit. Specifically, the switch is switched on from the start of each AC power source half-cycle, and after a certain period of time corresponding to the dimming positions, the switch is switched off till the end of the half cycle. After passing the zero-crossing point, the same operation is repeated, thus changing the effective value of the AC current.

However, when using the leading-edge phase cut dimmer (SCR-based) to modulate the LED lights, components like capacitors are needed in the dimming circuit to provide a holding current that keeps the leading-edge phase cut dimmer (SCR-based) conducting. If there is no dimmer in the dimming circuit or a trailing-edge phase cut dimmer (transistor-based) is used in the dimming circuit, the waveform outputted by the dimming circuit may be influenced due to charging/discharging processes of the components like capacitors. Accordingly, the phenomenon of LED lamp flicker occurs.

The disclosed dimmer control circuit, dimmer control method, and lighting device are directed to solve one or more problems set forth above and other problems.

BRIEF SUMMARY OF THE DISCLOSURE

The present disclosure provides a dimmer control circuit, a dimmer control method and a lighting device, where the dimmer control circuit can facilitate normal access and operations for both SCR-based leading-edge phase cut dimmer and transistor-based trailing-edge phase cut dimmer.

One aspect or embodiment of the present disclosure includes a dimming output end, a detection-control module, a current holding module, and a load terminal. The dimming output end is configured to connect to a dimmer. The load terminal is configured to connect to a load. An input end of the detection-control module is connected to an output end of the dimmer. Further, an output end of the detection-control module is configured to: control the current holding module to connect to the load terminal when the dimming output end is connected to a silicon controlled rectifier based (SCR-based) leading-edge phase cut dimmer, and control the current holding module to disconnect from the load terminal when the dimming output end is not connected to the SCR-based leading-edge phase cut dimmer. The current holding module is configured to supply a holding current to the SCR-based leading-edge phase cut dimmer connected to the dimming output end.

Optionally, the dimmer control circuit may further include a switch. The switch may include a controlled end, a first contact end, and a second contact end. The controlled end of the switch is connected to the output end of the detection-control module, the first contact end is connected to the current holding module, and the second contact end is connected to the load terminal.

Optionally, the current holding module may include a capacitor, and when the current holding module is connected to the load terminal, the capacitor is connected to the load terminal in parallel.

Optionally, the detection-control module may include a detection module and a control module. An input end of the detection module is the input end of the detection-control module, an output end of the detection module is connected to an input end of the control module, and an output end of the control module is the output end of the detection-control module. The detection module is configured to detect whether the dimming output end is connected to the SCR-based leading-edge phase cut dimmer. Further, the control module is configured to: control the current holding module to connect to the load terminal when the dimming output end is connected to the SCR-based leading-edge phase cut dimmer, and control the current holding module to disconnect from the load terminal when the dimming output end is not connected to the SCR-based leading-edge phase cut dimmer.

Optionally, the dimmer control circuit further includes a power conversion module to facilitate normal operations of a connected LED lamp. An input end of the power conversion module is connected to the dimming output end, an output end of the power conversion module is connected to the load terminal, and the power conversion module is configured to convert an input voltage to a voltage ensures operation of the load.

Optionally, the dimmer control circuit further includes a rectifier bridge. An AC end of the rectifier bridge is connected to the dimming output end, and a DC end of the rectifier bridge is connected to the load terminal.

Optionally, the detection module may further include a rising edge detection circuit and a first signal collection circuit. The rising edge detection circuit is configured to detect whether the dimming output end has a rising edge signal. The first signal collection circuit is configured to: determine that the dimming output end is connected to the SCR-based leading-edge phase cut dimmer if the rising edge detection circuit detects a rising edge signal, and determine that the dimming output end is not connected to the SCR-based leading-edge phase cut dimmer if the rising edge detection circuit detects no rising edge signal.

Optionally, the detection module may further include a voltage detection circuit and a second signal collection circuit. The voltage detection circuit is configured to detect a voltage outputted by the dimming output end. The second signal collection circuit is configured to: determine that the dimming output end is connected to the SCR-based leading-edge phase cut dimmer if the voltage detected by the voltage detection circuit is higher than a pre-defined threshold, and determine that the dimming output end is not connected to the SCR-based leading-edge phase cut dimmer if the voltage detected by the voltage detection circuit is smaller than or equal to the pre-defined threshold.

Another aspect or embodiment of the present disclosure includes a lighting device, including the dimmer control circuit as described above, and a load. The load terminal of the dimmer control circuit is connected to the load.

Another aspect or embodiment of the present disclosure includes a dimmer circuit control method, including determining whether a front end of a dimmer control circuit is connected to a SCR-based leading-edge phase cut dimmer. The dimmer control circuit includes a dimming output end, a detection-control module, a current holding module, and a load terminal. The current holding module is configured to provide a holding current to the SCR-based leading-edge phase cut dimmer. When the dimmer control circuit is connected to the SCR-based leading-edge phase cut dimmer, the current holding module is connected to the load terminal of the dimmer control circuit. When the dimmer control circuit is not connected to the SCR-based leading-edge phase cut dimmer, the current holding module is disconnected from the load terminal of the dimmer control circuit.

Optionally, determining whether the front end of the dimmer control circuit is connected to the SCR-based leading-edge phase cut dimmer may further include: detecting whether the front end of the dimmer control circuit has a rising edge signal; determining that the front end of the dimmer control circuit is connected to the SCR-based leading-edge phase cut dimmer if the front end of the dimmer control circuit has the rising edge signal, and determining that the front end of the dimmer control circuit is not connected to the SCR-based leading-edge phase cut dimmer if the front end of the dimmer control circuit has no rising edge signal.

Optionally, determining whether the front end of the dimmer control circuit is connected to the SCR-based leading-edge phase cut dimmer may further include: detecting a front end voltage of the dimmer control circuit; determining that the front end of the dimmer control circuit is connected to the SCR-based leading-edge phase cut dimmer if the front end voltage of the dimmer control circuit is higher than a pre-defined threshold, and determining that the front end of the dimmer control circuit is not connected to the SCR-based leading-edge phase cut dimmer if the front end voltage of the dimmer control circuit is smaller than or equal to the pre-defined threshold.

The present disclosure provides a dimmer control circuit, a dimmer control method and a lighting device. The dimmer control circuit includes a dimming output end, a detection-control module, a current holding module, and a load terminal. The dimming output end is configured to connect to a dimmer. The load terminal is configured to connect to a load. An input end of the detection-control module is connected to an output end of the dimmer. Further, an output end of the detection-control module is configured to: control the current holding module to connect to the load terminal when the dimming output end is connected to a SCR-based leading-edge phase cut dimmer, and control the current holding module to disconnect from the load terminal when the dimming output end is not connected to the SCR-based leading-edge phase cut dimmer. The current holding module is configured to supply a holding current to the SCR-based leading-edge phase cut dimmer connected to the dimming output end. In this way, when the dimming output end is connected to a transistor-based trailing edge phase cut dimmer, or when no dimmer is connected to the dimmer control circuit, flickering phenomenon does not occur.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiment, persons of ordinary skill in the art may derive other embodiments consistent with the present disclosure, all of which are within the scope of the present invention.

Figure 1:
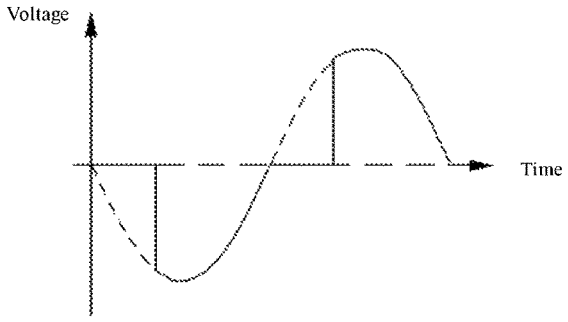
FIG. 1 (Prior Art)
FIG. 1 illustrates a wave-function diagram of a leading-edge phase cut AC sinusoidal voltage consistent with various disclosed embodiments.
Figure 2:
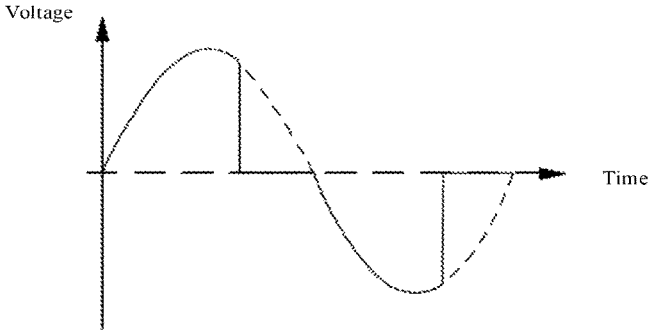
FIG. 2 (Prior Art)
FIG. 2 illustrates a wave-function diagram of a trailing-edge phase cut AC sinusoidal voltage consistent with various disclosed embodiments.
Figure 3:
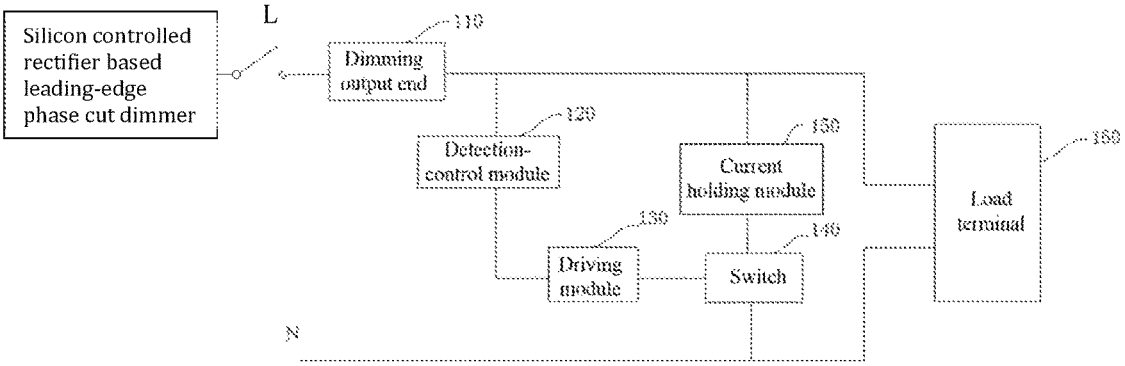
FIG. 3 illustrates a block diagram of an exemplary dimmer control circuit consistent with the disclosed embodiment.

FIG. 3 illustrates a block diagram of an exemplary dimmer control circuit consistent with the disclosed embodiment. As shown in FIG. 3, the dimmer control circuit may include a dimming output end 110, a detection-control module 120, a current holding module 150, and a load terminal 160. An output end of the dimming output end 110 may be connected to an input end of the detection-control module 120 (e.g., via the dimming output end 110), an input end of the current holding module 150 may be connected to the input end of the detection-control module 120, and an output end of the current holding module 150 may be connected to a load. The dimming output end 110 may be used to incorporate a dimmer to the circuit. The detection-control module 120 may be used to detect whether the dimming output end 110 is connected to a leading-edge phase cut dimmer (SCR-based). The current holding module 150 may be used to supply a holding current that keeps the leading-edge phase cut dimmer (SCR-based) conducting. The load terminal 160 may be connected with to a LED lamp.

Specifically, when the dimming output end 110 is connected to the leading-edge phase cut dimmer (SCR-based), the detection-control module 120 may control the current holding module 150 to connect to the load terminal 160, and the current holding module 150 may supply the holding current for normal operations of the leading-edge phase cut dimmer (SCR-based). When the dimming output end 110 is not connected to a leading-edge phase cut dimmer (SCR-based), the detection-control module 120 may control the current holding module 150 to be disconnected from the load terminal 160.

Further, as shown in FIG. 3, the dimmer control circuit 100 may also include a switch 140. The switch 140 may include a controlled end, a first contact end (also called first triggering end) and a second contact end (also called second triggering end). Specifically, an output end of the detection-control module 120 may be connected to the controlled end of the switch 140, the first contact end of the switch 140 may be connected to the output end of the current holding module 150, and the second contact end of the switch 140 may be connected to the load terminal 160. That is, the detection-control module 120 may connect or disconnect the current holding module 150 from the load terminal 160 via the switch 140.

Further, as shown in FIG. 3, the dimmer control circuit 100 may also include a driving module 130. An input end of the driving module 130 may be connected to the detection-control module 120, and an output end of the driving module 130 may be connected to the controlled end of the switch 140. Specifically, the driving module 130 may receive a control signal sent by the detection-control module 120, and may drive a first triggering end of the switch 140 to be switched on or switched off. In this embodiment, the driving module 130 may be a metal oxide superconductor (MOS) transistor, or another driving module commonly used in this technical field that for connecting to a switch. The type of the driving module 130 is only for illustrative purpose, and is not intended to limit the scope of the present disclosure.

Specifically, when the detection-control module 120 detects that the dimming output end 110 is connected to the leading-edge phase cut dimmer (SCR-based), the detection-control module 120 may send a control signal to the driving module 130 that switches on the switch 140. For example, the control signal may be "1". After receiving the control signal "1", the driving module 130 may control the first triggering end of the switch 140 to be switched on, and the current holding module 150 may be connected to the load terminal 160 in parallel. If the detection-control module 120 does not detect that the dimming output signal is connected to the leading-edge phase cut dimmer (SCR-based), the detection-control module 120 may send a control signal to the driving module 130 to switch off the switch 140. For example, the signal may be "0". After receiving the control signal "0", the driving module 130 may control the first triggering end of the switch 140 to be switched off, and the current holding module 150 may be disconnected from the load terminal 160.

Specifically, a situation where the dimming output end 110 is not connected to a leading-edge phase cut dimmer (SCR-based) may refer to a situation where the dimming output end 110 is connected to a trailing-edge phase cut dimmer (transistor-based), or a situation where the dimming output end 110 is not connected to a dimmer, or other similar situations.

The disclosed current holding module 150 may consist of resistor, capacitor, resistor and capacitor connected in series, or other arrangements of electrical components, or may be a current holding and energy storage device commonly used in this technical field. The configuration of the current holding module 150 is only for illustrative purpose, and is not intended to limit the scope of the present disclosure.

Further, a function of the current holding module 150 may be to provide the holding current to the leading-edge phase cut dimmer (SCR-based). The leading-edge phase cut dimmer (SCR-based) may use a SCR device to modulate a power of output lights. SCR is short for silicon controlled rectifier, which may be a semiconductor device consists of three PN junctions, a four-layered silicon chip, and three electrodes. The three electrodes of the SCR device may be an anode (A), a cathode (K), and a gate electrode (G), respectively. When the anode of the SCR device is connected to a negative voltage level (compared to the cathode), the PN junction may be reversed, and may show reverse characteristics similar to diodes. When the anode of the SCR device is connected to a positive voltage level that is higher than a break-over voltage, the SCR device may rapidly switch to a low-resistance ON state. When the voltage applied between the anode and the cathode of the SCR device is lower than the break-over voltage, the SCR device may be in a high-resistance OFF state. At this time, if a proper positive voltage is applied on the gate electrode (to the cathode), the SCR may be rapidly activated and switched to ON state. Once the SCR device is ON, the gate electrode may lose its controlling effect.

Accordingly, after the SCR device is turned on, even if the gate electrode voltage is removed, the SCR device may remain to be ON as long as a minimum forward current is applied on two electrode ends of the SCR device. The minimum forward current may be called the holding current.

Figure 4:
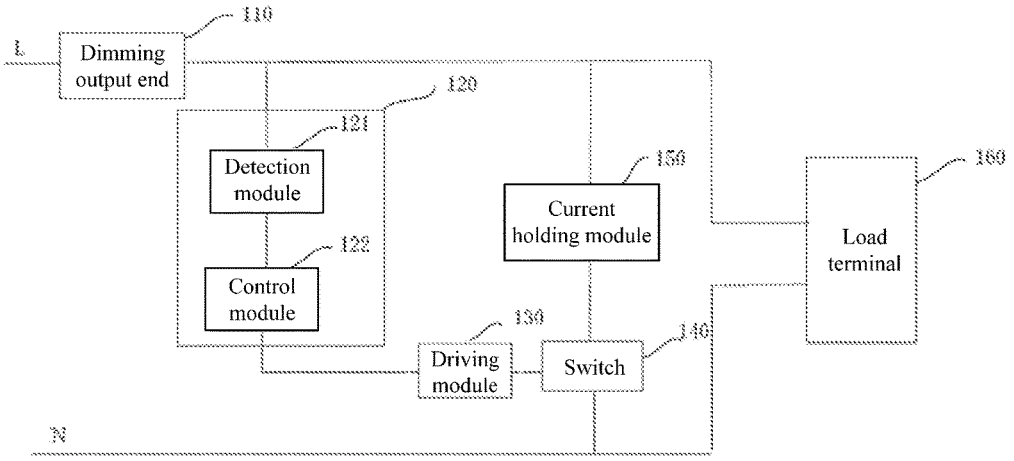
FIG. 4 illustrates a block diagram of another exemplary dimmer control circuit consistent with the disclosed embodiment.

Further, FIG. 4 illustrates a block diagram of another exemplary dimmer control circuit 100 consistent with the disclosed embodiment. As shown in FIG. 4, the detection-control module 120 may include a detection module 121 and a control module 122. An output end of the detection module 121 may be connected to an input end of the control module 122. An output end of the control module 122 may be connected to the driving module 130. The detection module 121 may be used to detect whether the dimming output end 110 is connected to the leading-edge phase cut dimmer (SCR-based), and the control module 122 may be used to control switched-on and switched-off of the switch 140. The control module 122 may include a micro-controller unit (MCU).

In this embodiment, the dimmer control circuit 100 may include a dimming output end 110, a detection-control module 120, a current holding module 150, and a load terminal 160. The detection-control module 120 may also include a detection module 121 and a control module 122. In the disclosed dimmer control circuit 100, the dimming output end 110 may be connected to the dimmer, and the load terminal 160 may be connected to the load. Further, the output end of the detection module 121 in the detection-control module 120 may connect to an output end of the dimmer. The output end of the control module 122 in the detection-control module 120 may be used to connect the current holding module 150 to the load terminal 160 when the dimming output end 110 is connected to the leading-edge phase cut dimmer (SCR-based). Or, the output end of the control module 122 in the detection-control module 120 may disconnect the current holding module 150 from the load terminal 160 when the dimming output end 110 is not connected to a leading-edge phase cut dimmer (SCR-based). The current holding module 150 may be used to provide the 'holding current' to the leading-edge phase cut dimmer (SCR-based) that connects to the dimming output end 110.

Accordingly, the detection module 121 in the detection-control module 120 may detect whether the dimming output end 110 is connected to the leading-edge phase cut dimmer (SCR-based). Accordingly, when the dimming output end 110 is connected to the leading-edge phase cut dimmer (SCR-based), the control module 122 in the detection-control module 120 may control the driving module 130 to switch on the switch 140, and the current holding module 150 may be connected to the load, thus providing the holding current to the leading-edge phase cut dimmer (SCR-based). When the dimming output end 110 is connected to the trailing-edge phase cut dimmer (transistor-based) or is not connected to a dimmer, the control module 122 in the detection-control module 120 may control the driving module 130 to switch off the switch 140, and the current holding module 150 may be disconnected from the load. Accordingly, the scintillation problem in LED lamps may be solved under the situations where the dimming output end 110 is connected to the trailing-edge phase cut dimmer (transistor-based) or is not connected to a dimmer.

Figure 5:
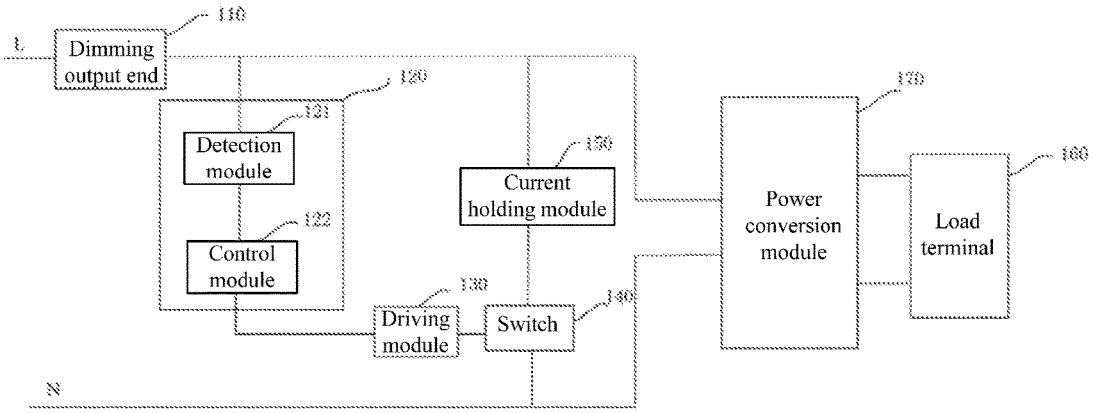
FIG. 5 illustrates a block diagram of another exemplary dimmer control circuit consistent with the disclosed embodiment.

FIG. 5 illustrates a block diagram of another exemplary dimmer control circuit 100 consistent with the disclosed embodiment. As shown in FIG. 5, the dimmer control circuit 100 may also include a power conversion module 170. In one example, the input end of the power conversion module 170 may connect to the dimming output end 110 or an output end of a rectifier bridge, and the output end of the power conversion module 170 may connect to the load terminal 160. The power conversion module may be configured to convert an input voltage to a suitable voltage for the load, which ensures normal operation of the load.

Specifically, the power conversion module 170 may be used for power conversion. The power conversion module 170 may be a power module that realizes power conversion between direct current and direct current, or a power module that realizes power conversion between AC and direct current. For example, the power conversion module 170 may be any adapter, or may be an electric circuit device. A voltage of a LED lamp under normal operation conditions may be relatively small, and different LED lamps may have different working voltages (typically 2-6 V). The disclosed power conversion module 170 may convert a current in an input end to a current that supports normal operation of the load. This is related to the luminescence principle of LED lamps.

In this embodiment, the structure, implementation principle, and technical effect of the disclosed dimmer control circuit 100 may be similar to the disclosed embodiments as shown in FIG. 3 and FIG. 4. Further, the situation where the dimming output end 110 is not connected to a leading-edge phase cut dimmer (SCR-based) may refer to the situation where the dimming output end 110 is connected to the trailing-edge phase cut dimmer (transistor-based), or the situation where the dimming output end 110 is not connected to a dimmer, or other similar situations.

In this embodiment, the current holding module 150 may consist of resistor, capacitor, resistor and capacitor connected in series, or other arrangements of electrical components.

In this embodiment, a power conversion module 170 may be connected to the dimmer control circuit 100, the input end of the power conversion module 170 may connect to the dimming output end 110, the output end of the power conversion module 170 may connect to the load terminal 160, and the power conversion module 170 may be used to convert an input voltage to a voltage that supports the operation of the load, thus ensuring normal operation of the load.

Figure 6:
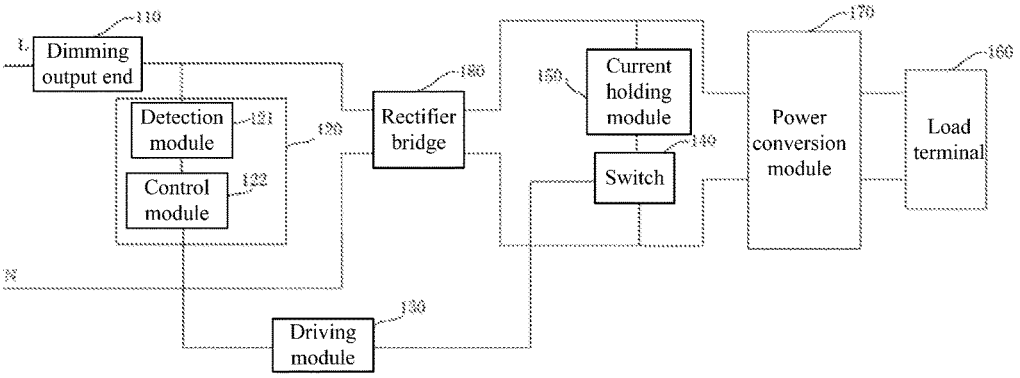
FIG. 6 illustrates a block diagram of an exemplary dimmer control circuit where a current holding module is disposed before a rectifier bridge consistent with the disclosed embodiment.
Figure 7:
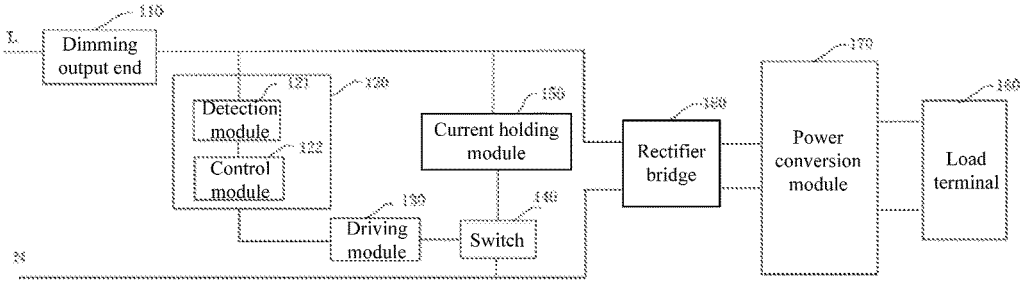
FIG. 7 illustrates a block diagram of an exemplary dimmer control circuit where a current holding module is disposed after a rectifier bridge consistent with the disclosed embodiment.

To realize connection of different power supply structures in the disclosed dimmer control circuits, a rectifier bridge 180 may be connected to the dimmer control circuit 100. FIG. 6 illustrates a block diagram of an exemplary dimmer control circuit where a current holding module is disposed before a rectifier bridge consistent with the disclosed embodiment. FIG. 7 illustrates a block diagram of an exemplary dimmer control circuit where a current holding module is disposed after a rectifier bridge consistent with the disclosed embodiment. As shown in FIG. 6 and FIG. 7, an AC current may be converted to a direct current for the LED lamp to continuously emit light, the rectifier bridge 180 may be connected to the dimmer control circuit 100 to convert the AC current to the direct current to ensure normal operation of the LED lamp.

In this embodiment, the dimmer control circuit 100 may include a rectifier bridge 180 that converts an AC current to a direct current. Via different connections of the rectifier bridge 180 in the dimmer control circuit 100, the connection between electric power circuits in different electric power structures and the dimmer control circuit 100 may be realized, thus ensuring the versatility of the dimmer control circuit 100. Further, the input end of the power conversion module 170 may connect to the output end of the rectifier bridge 180.

Figure 8:
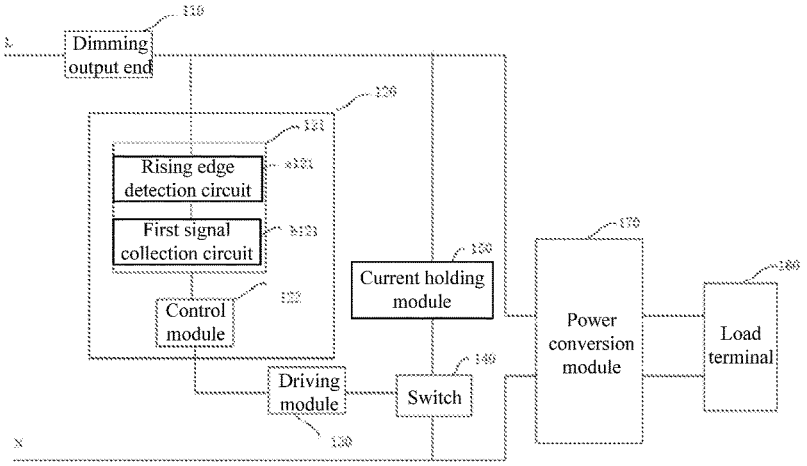
FIG. 8 illustrates a block diagram of another exemplary dimmer control circuit consistent with the disclosed embodiment.

FIG. 8 illustrates a block diagram of another exemplary dimmer control circuit consistent with the disclosed embodiment. As shown in FIG. 8, the detection module 121 may include a circuit to detect a rising edge. Specifically, the detection module 121 may also include a rising edge detection circuit a121 and a first signal collection circuit b121. An input end of the rising edge detection circuit a121 may connect to the dimming output end 110, an output end of the rising edge detection circuit a121 may connect to an input end of the first signal collection circuit b121, and an output end of the first signal collection circuit b121 may connect to the input end of the control module 122.

Specifically, the rising edge detection circuit a121 may detect whether there is a rising edge signal at the dimming output end 110. If the rising edge signal is detected, the rising edge detection circuit a121 may transit the rising edge signal to the first signal collection circuit b121, the first signal collection circuit b121 may determine whether the dimming output end 110 is connected to the leading-edge phase cut dimmer (SCR-based), and send the determined information to the control module 122. The control module 122 may send a control signal (e.g., signal "1") that switches on the switch 140 to the driving module 130. After receiving the signal, the driving module 130 may control the first contact end of the switch 140 to be switched on, at this time, the current holding module 150 may connect to the load, thus providing a holding current to the leading-edge phase cut dimmer (SCR-based).

If the rising edge detection circuit a121 does not detect a rising edge signal in the dimming output end 110, the rising edge detection circuit a121 may send the signal with no rising edge detected to the first signal collection circuit b121. The first signal collection circuit b121 may determine that, at this time, the dimming output end 110 is not connected to a leading-edge phase cut dimmer (SCR-based), and send this determined signal to the control module 122. The control module 122 may output the control signal (e.g., signal "0") that switch off the switch 140. The driving module 130 may control the first triggering end of the switch 140 to be switched off, and the current holding module 150 may be disconnected from the load.

Further, a waveform of a leading-edge phase cut AC sinusoidal voltage may start with an AC phase of zero, and starting from the AC phase zero, the input voltage may be chopped until the SCR device is turned on. Accordingly, in every half cycle, there may be a rising edge. For a waveform of a trailing-edge phase cut AC sinusoidal voltage, because a transistor may be turned on from the AC phase zero and be turned off after a certain period of time corresponding to the dimming positions, in every half cycle, there may be no rising edge. By detecting whether a rising edge exists, whether the dimming output end is connected to the leading-edge phase cut dimmer (SCR-based) or not may be determined.

The disclosed detection module 121 may include the rising edge detection circuit a121 and the first signal collection circuit b121. Via the rising edge detection circuit a121 and the first signal collection circuit b121, whether the dimming output end 110 is connected to the leading-edge phase cut dimmer (SCR-based) or not may be determined. Accordingly, the detection module 121 may detect the dimming output end 110, and the current holding module 150 may accurately connect or disconnect from the load.

Figure 9:
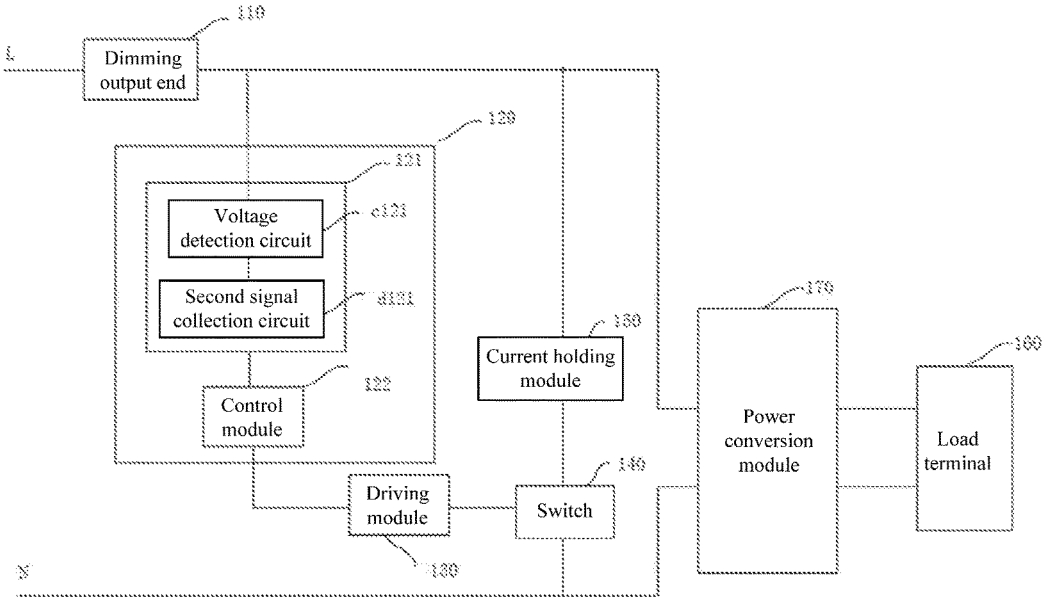
FIG. 9 illustrates a block diagram of another exemplary dimmer control circuit consistent with the disclosed embodiment.

FIG. 9 illustrates a block diagram of another exemplary dimmer control circuit consistent with the disclosed embodiment. As shown in FIG. 9, the detection module 121 may also include a voltage detection circuit c121 and a second signal collection circuit d121. An input end of the voltage detection circuit c121 may be connected to the dimming output end 110, an output end of the voltage detection circuit c121 may be connected to an input end of the second signal collection circuit d121, and an output end of the second signal collection circuit d121 may be connected to the input end of the control module 122.

Further, two voltages may be needed for normal operation of the SCR device: a gate electrode voltage and a holding voltage. The gate electrode voltage may be used to turn on the SCR device, and the holding voltage may be used to keep the SCR device conducting. For the transistor, as long as there is a voltage, the transistor may be on, and no gate electrode voltage may be needed. Accordingly, when the dimming output end 110 is connected to the leading-edge phase cut dimmer (SCR-based), at the moment the SCR device is turned on, the voltage outputted from the dimming output end 110 may at least be higher than or equal to the gate electrode voltage used to switch on the SCR device. When the dimming output end 110 is connected to the trailing-edge phase cut dimmer (transistor-based), the voltage outputted from the dimming output end 110 may vary sinusoidally with an initial value of zero.

Specifically, the voltage detection circuit c121 may detect the voltage of the dimming output end 110, and send the voltage value to the second signal collection circuit d121. The second signal collection circuit d121 may compare the voltage value detected by the voltage detection circuit c121 with a pre-defined threshold. When the second signal collection circuit d121 determines that this voltage value is higher than the pre-defined threshold, the dimming output end 110 may incorporate the leading-edge phase cut dimmer (SCR-based), and send the determined information to the control module 122. The control module 122 may send the signal (e.g., signal "1") that switches on the switch 140 to the driving module 130. After receiving the signal, the driving module 130 may control the first contact end of the switch 140 to be switched on, and the current holding module 150 may be connected to the load. Or the second signal collection circuit d121 may determine that the voltage value is smaller than the pre-defined threshold, indicating the dimming output end 110 may incorporate no leading-edge phase cut dimmer (SCR-based). The control module 122 may control the switch 140 to be switched off, and the current holding module 150 may be disconnected from the load. The structure and function of the second signal collection circuit d121 may be similar to the disclosed first signal collection circuit b121, and the similarities are not repeated here.

In this embodiment, a situation where the dimming output end 110 is not connected to a leading-edge phase cut dimmer (SCR-based) may refer to a situation where the dimming output end 110 is connected to the trailing-edge phase cut dimmer (transistor-based), or a situation where the dimming output end 110 is not connected to a dimmer, or some other situations.

In this embodiment, the voltage detection circuit c121 and the second signal collection circuit d121 may be used to determine whether the dimming output end 110 is connected to the leading-edge phase cut dimmer (SCR-based). Because this embodiment only compares the voltage of the dimming output end 110 to the pre-defined threshold, the computation may be expedited. That is, compared to the embodiment illustrated in FIG. 8, the switch-on and switch-off of the switch 140 in this embodiment may be controlled to be faster.

Other than detection methods illustrated in FIG. 8 and FIG. 9, in this embodiment, the detection module 121 may be detected using a current.

Figure 10:
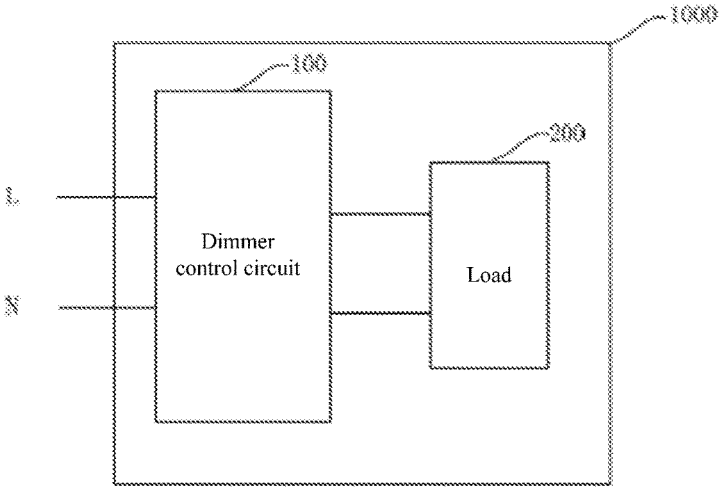
FIG. 10 illustrates an exemplary lighting device consistent with the disclosed embodiment.

FIG. 10 illustrates an exemplary lighting device consistent with the disclosed embodiment. As shown in FIG. 10, the disclosed lighting device 1000 may include a dimmer control circuit 100 and a load 200. An output end of the dimmer control circuit 100 may be connected to an input end of the load 200. The dimmer control circuit 100 may be a dimmer control circuit in any of the above disclosed embodiment. The structure, function and effect of the dimmer control circuit 100 may be similar to any dimmer control circuit in the above embodiments, which are not repeated here.

Specifically, the output end of the dimmer control circuit 100 may be connected to a dimmer, for example, a leading-edge phase cut dimmer (SCR-based) or a trailing-edge phase cut dimmer (transistor-based). The load may be a LED lamp.

In this embodiment, the lighting device may include the dimmer control circuit 100 and the load 200. The output end of the dimmer control circuit 100 may be connected to the input end of the load 200. Thus, via the detection module 121, whether the dimming output end 110 is connected to the leading-edge phase cut dimmer (SCR-based) may be determined, and the current holding module 150 may connect or disconnect to the load. When the dimming output end 110 is connected to the leading-edge phase cut dimmer (SCR-based), the detection-control module 120 may control the switch 140 to be switched on, and the current holding module 150 may be connected to the load 200. When the dimming output end 110 is connected to the trailing-end phase cut dimmer (transistor-based), the detection-control module 120 may control the switch 140 to be switched off, and the current holding module 150 may be disconnected from the load 200. Accordingly, the flickering problem in LED lamps may be solved under the situations where the dimming output end 110 is connected to the trailing-edge phase cut dimmer (transistor-based).

Figure 11:
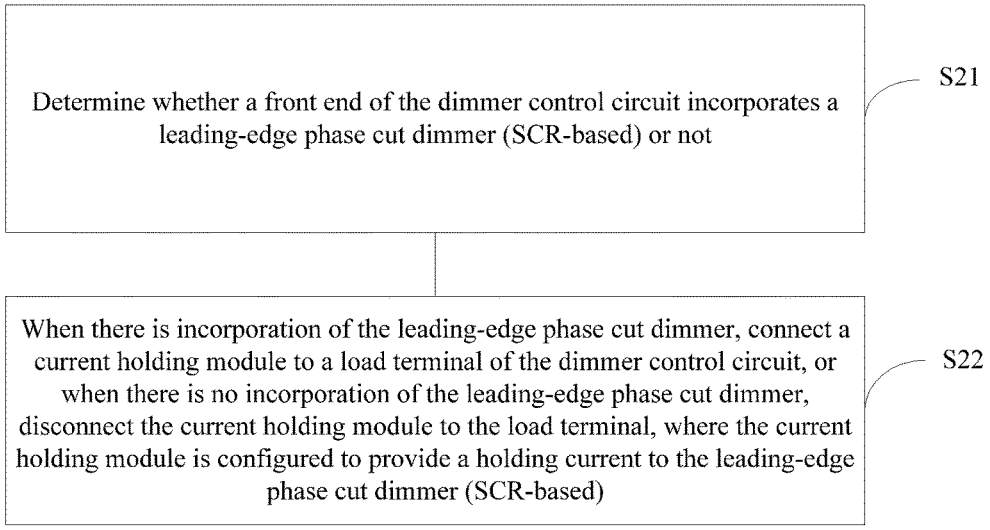
FIG. 11 illustrates an exemplary flow chart of a dimmer control method consistent with the disclosed embodiment.

FIG. 11 illustrates an exemplary flow chart of a dimmer control method consistent with the disclosed embodiment. As shown in FIG. 11, the disclosed method may include determining whether a front end of a dimmer control circuit is connected to a leading-edge phase cut dimmer (SCR-based) (S21). Specifically, a holding current may be needed to keep the leading-edge phase cut dimmer (SCR-based) on under a normal operation condition.

For a trailing-edge phase cut dimmer (transistor-based) under a normal operation condition, the holding current may not be needed, and if at the same time, a current holding module is turned on, charging and discharging of the current holding module may influence the waveform of the input voltage, resulting in the scintillation of the LED light.

The disclosed method may also include connecting the current holding module 150 to a load terminal 160 of the dimmer control circuit 100 when the dimming output end is connected to the leading-edge phase cut dimmer (SCR-based), or disconnecting the current holding module 150 from the load terminal 160 when the dimming output end is not connected to a leading-edge phase cut dimmer (SCR-based) (S22). The current holding module 150 may be used to provide the holding current to the leading-edge phase cut dimmer (SCR-based).

Specifically, the detection-control module 120 may detect the front end of the dimmer control circuit 100, and when the incorporation of the leading-edge phase cut dimmer (SCR-based) is detected, the detection-control module 120 may send out a control signal (e.g., signal "1") that switches on the switch 140, by then the first triggering end of the switch 140 is switched on, and the current holding module 150 may connect to the load to provide a holding current to the leading-edge phase cut dimmer (SCR-based). When no incorporation of the leading-edge phase cut dimmer (SCR-based) is detected, the detection-control module 120 may send out the control signal (e.g., signal "0") that switch off the switch 140, by then the first triggering end of the switch 140 may be switched off, and the current holding module 150 may be disconnected from the load.

In this embodiment, the current holding module 150 may consist of resistor, capacitor, resistor and capacitor connected in series, or other arrangements of electrical components, which is not limited in the present disclosure.

The disclosed dimming controlling method may include determining whether the front end of the dimmer control circuit 100 is connected to the leading-edge phase cut dimmer (SCR-based). When the leading-edge phase cut dimmer (SCR-based) is connected to the circuit, the current holding module 150 may be connected to the load terminal 160 in the dimmer control circuit 100, when there is no incorporation of the leading-edge phase cut dimmer (SCR-based), the current holding module 150 may be disconnected from the load terminal 160. The disclosed dimming controlling method may be applied in the above disclosed dimmer control circuit, and the implementation principle and technical effect are similar.

Figure 12:
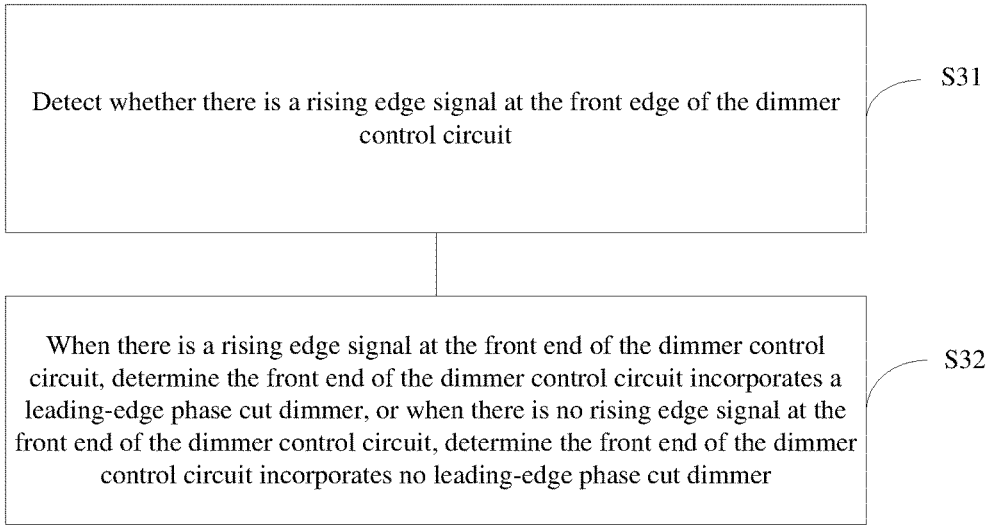
FIG. 12 illustrates another exemplary flow chart of a dimmer control method consistent with the disclosed embodiment.

FIG. 12 illustrates another exemplary flow chart of a dimmer control method consistent with the disclosed embodiment. As shown in FIG. 12, the disclosed method may provide specific steps that determines whether the front end of the dimmer control circuit 100 is connected to the leading-edge phase cut dimmer (SCR-based). Specifically, the disclosed method may include detecting whether there is a rising edge signal in the front end of the dimmer control circuit 100 (S31). Specifically, when the front end of the dimmer control circuit 100 is connected to the leading-edge phase cut dimmer (SCR-based), because the leading-edge phase cut dimmer (SCR-based) is turned off to chop voltage from the start of each half-cycle until triggered to be turned on, at the moment of being turned on, the voltage level may dramatically increase from 0 to a high voltage level. That is, at the moment the voltage level signal changes, a rising edge signal may occur. When the front end of the dimmer control circuit 100 is connected to the trailing-edge phase cut dimmer (transistor-based) or is not connected to a dimmer, the voltage may vary sinusoidally from the start of each electrical power source half-cycle, and there may not be rising edge signals that instantly increases from a low voltage level to a high voltage level.

The disclosed method may include determining that the front end of the dimmer control circuit 100 is connected to the leading-edge phase cut dimmer (SCR-based) if the front end of the dimmer control circuit 100 has a rising edge signal, or determining that the front end of the dimmer control circuit 100 is not connected to a leading-edge phase cut dimmer (SCR-based) if the front end of the dimmer control circuit 100 has no rising edge signal (S32).

Specifically, when the front end of the dimmer control circuit 100 has a rising edge signal, it may be determined that the front end of the dimmer control circuit 100 is connected to the leading-edge phase cut dimmer (SCR-based). If the front end of the dimmer control circuit 100 has no rising edge signal, it may be determined that the trailing-edge phase cut dimmer (transistor-based) is connected, or there is no incorporation of the dimmer. The ON and OFF states of the current holding module 150 may be controlled according to whether the leading-edge phase cut dimmer (SCR-based) is connected. The disclosed controlling method may realize the dimmer control circuit 100 as shown in FIG. 8. The specific controlling method may have been illustrated in details in above embodiments, and may not be repeated here.

In this embodiment, whether the front end of the dimmer control circuit 100 is connected to the leading-edge phase cut dimmer (SCR-based) may be determined. First, whether there is a rising edge signal at the front end of the dimmer control circuit may be detected. If there is a rising edge signal at the front end of the dimmer control circuit 100, the front end of the dimmer control circuit 100 may be determined to be connected to the leading-edge phase cut dimmer (SCR-based). If there is no rising edge signal at the front end of the dimmer control circuit 100, the front end of the dimmer control circuit 100 may be determined to incorporate the leading-edge phase cut dimmer (SCR-based). That is, by detecting whether there is a rising edge signal, whether the leading-edge phase cut dimmer (SCR-based) is connected may be determined, and further, the ON and OFF states of the current holding module 150 that provides a holding current may be controlled. The determination method may be simple and effective.

Figure 13:
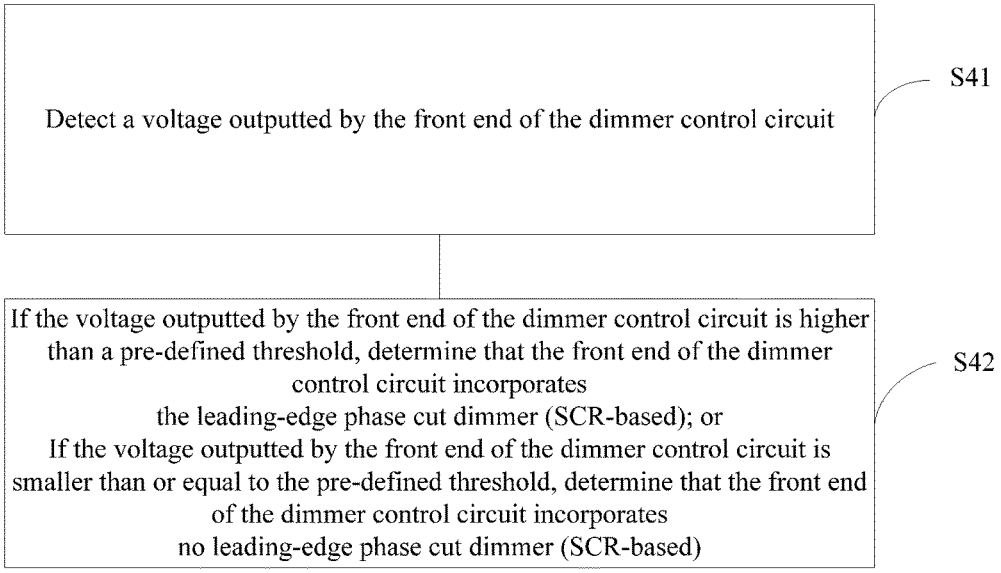
FIG. 13 illustrates another exemplary flow chart of a dimmer control method consistent with the disclosed embodiment.

FIG. 13 illustrates another exemplary flow chart of a dimmer control method consistent with the disclosed embodiment. As shown in FIG. 13, compared to the disclosed embodiment illustrated in FIG. 12, the method that determines whether the front end of the dimmer control circuit 100 is connected to the leading-edge phase cut dimmer (SCR-based) may be realized by detecting the voltage of the dimming output end 110.

Specifically, the method may include detecting the front end voltage of the dimmer control circuit 100 (S41). When the front end of the dimmer control circuit 100 is connected to the leading-edge phase cut dimmer (SCR-based), first, a triggering voltage (i.e., gate electrode voltage) may be needed to turn on the SCR device. The switched-on SCR device may be in a low-resistance state, and a very small voltage may keep the SCR device conducting. Accordingly, when the front end of the dimmer control circuit 100 is connected to the leading-edge phase cut dimmer (SCR-based), the front end of the dimmer control circuit 100 may generate a relatively high triggering voltage at the moment the SCR device is turned on. When the front end of the dimmer control circuit 100 is connected to the trailing-edge phase cut dimmer (transistor-based), at the moment the circuit is conducted, the voltage may vary sinusoidally with an initial value of zero, and no triggering voltage may occur.

If the front end voltage of the dimmer control circuit 100 is higher than the predefined threshold, the front end of the dimmer control circuit 100 may be determined to incorporate the leading-edge phase cut dimmer (SCR-based), and if the front end voltage of the dimmer control circuit 100 is smaller than or equal to the predefined threshold, the front end of the dimmer control circuit 100 may be determined to incorporate the leading-edge phase cut dimmer (SCR-based) (S42).

Specifically, when the voltage outputted by the front end of the dimmer control circuit 100 is higher than the predefined threshold, the front end of the dimmer control circuit 100 may be determined to incorporate the leading-edge phase cut dimmer (SCR-based). If the voltage outputted by the front end of the dimmer control circuit 100 is smaller than or equal to the predefined threshold, the front end of the dimmer control circuit 100 may be determined to incorporate the trailing-edge phase cut dimmer (transistor-based), or incorporate no dimmer. At this time, ON and OFF states of the current holding module 150 may be controlled according to whether the leading-edge phase cut dimmer (SCR-based) is connected. The specific controlling method may have been illustrated in details in above embodiments, and may not be repeated here.

In this embodiment, whether the front end of the dimmer control circuit 100 is connected to the leading-edge phase cut dimmer (SCR-based) may be determined via voltage detection. First, the voltage outputted by the front end of the dimmer control circuit 100 may be collected. If the collected voltage is higher than the predefined threshold, the front end of the dimmer control circuit 100 may be determined to incorporate the leading-edge phase cut dimmer (SCR-based). If the collected voltage is smaller than or equal to the predefined threshold, the front end of the dimmer control circuit 100 may be determined to incorporate no leading-edge phase cut dimmer (SCR-based). That is, by detecting the voltage outputted by the front end of the dimmer control circuit 100, whether the leading-edge phase cut dimmer (SCR-based) is connected to the circuit may be determined, thus controlling ON and OFF states of the current holding module 150 that provides the holding current.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

The dimmer control circuit provided by the present disclosure may solve the scintillation problem in LED lighting under situations where the dimming output end is connected to a trailing-edge phase cut dimmer or is not connected to a dimmer. Accordingly, the dimmer control circuit may satisfy normal incorporation of both leading-edge phase cut dimmer (SCR-based) and trailing-edge phase cut dimmer (transistor-based).

According to the dimmer control circuit, the related dimmer control method and lighting device of the present disclosure, the dimmer control circuit may solve the scintillation problem in LED lighting. In the dimmer control circuit, an output end of the detection-control module may be configured to control the current holding module to connect to the load terminal when there is incorporation of the leading-edge phase cut dimmer (SCR-based), or the output end of the detection-control module may be configured to control the current holding module to disconnect from the load terminal when there is no incorporation of the leading-edge phase cut dimmer (SCR-based), and the current holding module may be configured to provide a holding current to the leading-edge phase cut dimmer incorporated through the dimming output end. Accordingly, when the dimming output end is connected to trailing-edge phase cut dimmer or is not connected to a dimmer, the LED lamp may not blink.

The disclosed lighting device may include the disclosed dimmer control circuit and an LED lamp. The structure of the lighting device may include a base portion and a lamp portion. The lamp portion is the LED lamp, and the base portion connects the LED lamp with a power source. The dimmer control circuit may be integrated in a circuit board embedded in the base portion. The circuit board may be further configured to provide other lighting controls for the LED lamp, such as wireless communication. In some embodiments, the lighting device may not include a dimmer. The power source may include a dimmer (e.g., a dimmer-type switch of a lighting fixture in a household). When the lighting device is connected to the power source (e.g., the LED lamp is installed to a socket corresponding to the dimmer-type switch), the dimmer is connected to the dimming control circuit. The dimming control circuit may further determine whether the SCR-based dimmer is connected to the lighting device and decide whether the connect or disconnect the current holding module accordingly.

REFERENCE SIGN LIST dimmer control circuit 100
dimming output end 110
detection-control module 120
detection module 121
control module 122
driving module 130
switch 140
current holding module 150
load terminal 160
power conversion module 170
rectifier bridge 180
load 200
rising edge detection circuit a121
first signal collection circuit b121
voltage detection circuit c121
second signal collection circuit d121

What is claimed is:

1. A dimmer control circuit, comprising a dimming output end, a detection-control module including a detection module and a control module, a current holding module, and a load terminal, wherein:

the dimming output end is configured to connect to a dimmer, the load terminal is configured to connect to a load, an input end of the detection-control module is connected to an output end of the dimmer, an input end of the detection module is the input end of the detection-control module, an output end of the detection module is connected to an input end of the control module, and an output end of the control module is an output end of the detection-control module, the detection module is configured to detect whether the dimming output end is connected to a silicon controlled rectifier based (SCR-based) leading-edge phase cut dimmer, the control module is configured to:

control the current holding module to connect to the load terminal when the dimming output end is connected to the SCR-based leading-edge phase cut dimmer, and control the current holding module to disconnect from the load terminal when the dimming output end is not connected to the SCR-based leading-edge phase cut dimmer; and the current holding module is configured to supply a holding current to the SCR-based leading-edge phase cut dimmer connected to the dimming output end.

2. The dimmer control circuit according to claim 1, further comprising a switch including a controlled end, a first contact end, and a second contact end, wherein:

the controlled end of the switch is connected to the output end of the detection-control module, the first contact end is connected to the current holding module, and the second contact end is connected to the load terminal.

3. The dimmer control circuit according to claim 1, wherein the current holding module comprises a capacitor, and when the current holding module is connected to the load terminal, the capacitor is connected to the load terminal in parallel.

4. The dimmer control circuit according to claim 1, further comprising a power conversion module, wherein:

an input end of the power conversion module is connected to the dimming output end, an output end of the power conversion module is connected to the load terminal, and the power conversion module is configured to convert an input voltage to a voltage that ensures operation of the load.

5. The dimmer control circuit according to claim 1, further comprising a rectifier bridge, wherein:

an AC end of the rectifier bridge is connected to the dimming output end, and a DC end of the rectifier bridge is connected to the load terminal.

6. The dimmer control circuit according to claim 1, wherein the detection module comprises a rising edge detection circuit and a first signal collection circuit;

the rising edge detection circuit is configured to detect whether the dimming output end has a rising edge signal;

the first signal collection circuit is configured to:

determine that the dimming output end is connected to the SCR-based leading-edge phase cut dimmer if the rising edge detection circuit detects a rising edge signal, and determine that the dimming output end is not connected to the SCR-based leading-edge phase cut dimmer if the rising edge detection circuit detects no rising edge signal.

7. The dimmer control circuit according to claim 1, wherein the detection module comprises a voltage detection circuit and a second signal collection circuit;

the voltage detection circuit is configured to detect a voltage outputted by the dimming output end;

the second signal collection circuit is configured to:

determine that the dimming output end is connected to the SCR-based leading-edge phase cut dimmer if the voltage detected by the voltage detection circuit is higher than a pre-defined threshold, and determine that the dimming output end is not connected to the SCR-based leading-edge phase cut dimmer if the voltage detected by the voltage detection circuit is smaller than or equal to the pre-defined threshold.

8. A lighting device, comprising a dimmer control circuit and a load, wherein the dimmer control circuit includes a dimming output end, a detection-control module including a detection module and a control module, a current holding module, and a load terminal:

the dimming output end is configured to connect to a dimmer, the load terminal is configured to connect to the load, an input end of the detection-control module is connected to an output end of the dimmer, an input end of the detection module is the input end of the detection-control module, an output end of the detection module is connected to an input end of the control module, and an output end of the control module is an output end of the detection-control module, the detection module is configured to detect whether the dimming output end is connected to a silicon controlled rectifier based (SCR-based) leading-edge phase cut dimmer, the control module is configured to:

control the current holding module to connect to the load terminal when the dimming output end is connected to the SCR-based leading-edge phase cut dimmer, and control the current holding module to disconnect from the load terminal when the dimming output end is not connected to the SCR-based leading-edge phase cut dimmer; and the current holding module is configured to supply a holding current to the SCR-based leading-edge phase cut dimmer connected to the dimming output end.

9. The lighting device according to claim 8, further comprising a switch including a controlled end, a first contact end, and a second contact end, wherein:

the controlled end of the switch is connected to the output end of the detection-control module, the first contact end is connected to the current holding module, and the second contact end is connected to the load terminal.

10. The lighting device according to claim 8, wherein the current holding module comprises a capacitor, and when the current holding module is connected to the load terminal, the capacitor is connected to the load terminal in parallel.

11. The lighting device according to claim 8, further comprising a power conversion module, wherein:

an input end of the power conversion module is connected to the dimming output end, an output end of the power conversion module is connected to the load terminal, and the power conversion module is configured to convert an input voltage to a voltage that ensures operation of the load.

12. The lighting device according to claim 8, further comprising a rectifier bridge, wherein:

an AC end of the rectifier bridge is connected to the dimming output end, and a DC end of the rectifier bridge is connected to the load terminal.

13. The lighting device according to claim 8, wherein the detection module comprises a rising edge detection circuit and a first signal collection circuit;

the rising edge detection circuit is configured to detect whether the dimming output end has a rising edge signal;

the first signal collection circuit is configured to:

determine that the dimming output end is connected to the SCR-based leading-edge phase cut dimmer if the rising edge detection circuit detects a rising edge signal, and determine that the dimming output end is not connected to the SCR-based leading-edge phase cut dimmer if the rising edge detection circuit detects no rising edge signal.

14. The lighting device according to claim 8, wherein the detection module comprises a voltage detection circuit and a second signal collection circuit;

the voltage detection circuit is configured to detect a voltage outputted by the dimming output end;

the second signal collection circuit is configured to:

determine that the dimming output end is connected to the SCR-based leading-edge phase cut dimmer if the voltage detected by the voltage detection circuit is higher than a pre-defined threshold, and determine that the dimming output end is not connected to the SCR-based leading-edge phase cut dimmer if the voltage detected by the voltage detection circuit is smaller than or equal to the pre-defined threshold.

15. A dimmer control method, comprising:

determining whether a front end of a dimmer control circuit is connected to a SCR-based leading-edge phase cut dimmer, the dimmer control circuit including a dimming output end, a detection-control module, a current holding module, and a load terminal;

detecting whether the front end of the dimmer control circuit has a rising edge signal, or detecting a front end voltage of the dimmer control circuit;

determining that the front end of the dimmer control circuit is connected to the SCR-based leading-edge phase cut dimmer if the front end of the dimmer control circuit has the rising edge signal or if the front end voltage of the dimmer control circuit is higher than a pre-defined threshold;

determining that the front end of the dimmer control circuit is not connected to the SCR-based leading-edge phase cut dimmer if the front end of the dimmer control circuit has no rising edge signal or if the front end voltage of the dimmer control circuit is smaller than or equal to the pre-defined threshold;

connecting the current holding module to the load terminal of the dimmer control circuit when the dimmer control circuit is connected to the SCR-based leading-edge phase cut dimmer, wherein the current holding module is configured to provide a holding current to the SCR-based leading-edge phase cut dimmer; and disconnecting the current holding module from the load terminal of the dimmer control circuit when the dimmer control circuit is not connected to the SCR-based leading-edge phase cut dimmer.

* * * * *